US007065808B2

(12) United States Patent
Leung et al.

(10) Patent No.: US 7,065,808 B2
(45) Date of Patent: Jun. 27, 2006

(54) FOOT BATH

(75) Inventors: Anthony Kit Lun Leung, Hong Kong (CN); Kam Fai Fung, Hong Kong (CN)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/167,027

(22) Filed: Jun. 11, 2002

(65) Prior Publication Data

US 2003/0226201 A1 Dec. 11, 2003

(51) Int. Cl.
*A47K 3/022* (2006.01)
*A61H 33/00* (2006.01)
*E03C 1/00* (2006.01)

(52) U.S. Cl. ..... 4/622

(58) Field of Classification Search ..... 4/541.1, 4/621, 622; 601/22, 157, 158, 160, 166, 601/167; 607/85–87, 111; D24/213
See application file for complete search history.

(56) References Cited

U.S. PATENT DOCUMENTS 2,267,169 A * 12/1941 Rast ..... 4/622
3,034,139 A * 5/1962 Kapnick et al. ..... 601/157
3,055,357 A 9/1962 Redka
3,380,080 A 4/1968 Farrell
3,773,987 A 11/1973 Davis et al.
3,837,334 A 9/1974 Johnson
3,881,471 A 5/1975 Grube
3,965,495 A 6/1976 McNair
4,057,053 A 11/1977 Kunz
D250,206 S 11/1978 Levin
4,429,687 A 2/1984 Friedson et al.
4,446,885 A 5/1984 Nolden
4,497,313 A 2/1985 Kurosawa
4,513,735 A 4/1985 Friedson et al.
4,520,525 A 6/1985 Yogi et al.
4,523,580 A 6/1985 Tureaud
4,620,529 A 11/1986 Kurosawa
4,807,602 A 2/1989 Scarborough et al.
5,099,826 A 3/1992 Hayakawa
D327,949 S 7/1992 Bucher
D330,426 S 10/1992 Elkerbout
D363,555 S 10/1995 Lie
D364,466 S 11/1995 Assmann et al.
5,588,161 A 12/1996 Barradas (Continued)

FOREIGN PATENT DOCUMENTS

DE 37 36 476 2/1989

(Continued)

OTHER PUBLICATIONS

International Search Report dated Jan. 24, 2005 from International Application No. PCT/US03/40120.

*Primary Examiner*—Tuan Nguyen
(74) *Attorney, Agent, or Firm*—Lawrence Cruz; Steven A. Garner

(57) ABSTRACT

A foot therapy device is provided. The foot therapy device includes a housing having a side wall, and a floor defining a reservoir for receiving a fluid. The foot therapy device has at least one water jet disposed in the reservoir and a pump for pumping the fluid in the reservoir to the water jet. The water jet circulates the fluid disposed in the reservoir. The fluid circulates in a predetermined fluid flow pattern in the reservoir. The predetermined flow pattern of the fluid may include a substantially circular, elliptical or vortex motion for a relaxing and pleasant massage therapy.

22 Claims, 3 Drawing Sheets

U.S. PATENT DOCUMENTS

| | | | | |
|---|---|---|---|---|
| D378,968 | S | 4/1997 | Martin et al. | |
| D390,963 | S | 2/1998 | Scholpp | |
| 5,729,841 | A | 3/1998 | Chan | |
| 5,769,802 | A | 6/1998 | Wang | |
| D405,535 | S | 2/1999 | Schulz | |
| 5,868,688 | A | 2/1999 | Avidor et al. | |
| D419,682 | S | 1/2000 | Lie | |
| 6,149,611 | A | 11/2000 | Chen | |
| D436,180 | S | 1/2001 | Lie | |
| 6,253,893 | B1 | 7/2001 | Chi-Min | |
| 6,276,502 | B1 | 8/2001 | Leyba et al. | |
| 6,289,900 | B1 | 9/2001 | Kay | |
| 6,309,366 | B1 | 10/2001 | Maxwell | |
| 6,505,358 | B1 | 1/2002 | Ferber et al. | 4/622 |
| D455,498 | S | 4/2002 | Gillette et al. | D24/213 |
| 6,385,795 | B1 | 5/2002 | Ferber et al. | 4/622 |
| 6,438,768 | B1 * | 8/2002 | Yen | 4/622 |
| 6,568,000 | B1 * | 5/2003 | Kaufman et al. | 4/622 |
| 2002/0016990 | A1 | 2/2002 | Ferber | 4/622 |
| 2002/0056158 | A1 | 5/2002 | Ferber et al. | 4/622 |
| 2002/0133872 | A1 | 9/2002 | Ferber | 4/622 |

FOREIGN PATENT DOCUMENTS

| | | |
|---|---|---|
| DE | 38 11 517 | 4/1989 |
| DE | 38 09 287 | 9/1989 |
| DE | 44 19 146 | 6/1995 |
| EP | 0 064 178 | 11/1982 |
| GB | 2 314 015 | 12/1997 |
| JP | 646965 | 2/1992 |
| JP | 4090759 | 3/1992 |
| JP | 646963 | 2/1994 |
| JP | 646964 | 2/1994 |
| JP | 678858 | 3/1994 |
| JP | 6217896 | 4/1994 |
| JP | 6217897 | 4/1994 |
| JP | 6217895 | 8/1994 |
| JP | 6217898 | 8/1994 |
| JP | 6217899 | 8/1994 |
| JP | 6339509 | 12/1994 |
| JP | 8131556 | 5/1996 |
| JP | 9224863 | 2/1997 |
| JP | 2000-262575 | 9/2000 |
| JP | 2000-312652 | 11/2000 |

* cited by examiner

FOOT BATH

BACKGROUND OF THE INVENTION

1. Field of the Invention

The present invention relates to a foot bath therapy device. More particularly, the present invention relates to a portable foot bath having a reservoir with a plurality of adjustable jets disposed on a floor of the reservoir for creating a circular water flow pattern for massage therapy.

2. Description of the Prior Art

In the prior art, there are various known foot therapy massagers and bath devices. A number of these devices are capable of massaging the feet with dry heat, a vibrating massage with a liquid bath, or a supplemental heater. The prior art foot therapy devices may also provide a variety of vibrating massage sensations with a cold or hot liquid, and aerated bubble massage sensations, either alone or in combination. Generally, an objective in the prior art foot therapy devices is to provide relief to a user by increasing blood circulation in the feet by providing soothing, therapeutic stimulus to the user's feet. The user typically places her/his feet into a compartment of heated liquid in order to soften the user's skin, muscles and body tissues and obtain a relaxing massage and increased blood circulation to the feet.

However, the prior art foot therapy devices are limited. Typically, the massage experienced by the user is accomplished by a vibrating massage and the heat of the fluid. Prior art foot therapy devices are limited in the therapeutic results they produce since they fail to produce an effective massaging sensation and therapy attributed from the continuous movement or circulation of the fluid disposed in the foot therapy device.

Although, the prior art foot therapy devices have fluid disposed in the foot therapy device, other foot baths have a reservoir or tub where the fluid's flow pattern, if any, is attributed primarily to a vibrating mechanism. A vibrating mechanism chaotically shakes the fluid disposed in the reservoir. This chaotic and random flow pattern is distracting and aesthetically displeasing to the user, especially in the instance of massage therapy. Thus, uneven and random fluid flow patterns produced by the prior art may be asymmetric based on the shape of the bowl. The flow patterns, if any, are generally uninviting and undesirable as they are distracting to the user. Chaotic flow is counter productive with respect to foot therapy devices.

Further, prior art foot therapy devices do not provide a relaxing liquid flow pattern or an attendant massage therapy from the liquid flow pattern. Additionally, with the prior art's massaging devices, any soothing and relaxing therapeutic benefit(s) gained by use of the foot therapy devices is constrained by the inconvenient, proactive manner in which the user must scrub their feet upon the foot therapy device in order to achieve foot massaging sensations.

Therefore, there exists a need to provide a foot bath that has an adjustable water jet for creating a predetermined fluid flow pattern in fluid disposed in the foot bath for an increased foot therapy experience.

SUMMARY OF THE INVENTION

It is an object of the present invention to provide a foot bath having an adjustable water jet for controlling the fluid flow pattern created in the foot bath.

It is another object of the present invention to provide a foot bath that provides a vortex, elliptical or circular fluid flow pattern with the fluid disposed in the foot bath to circulate in the foot bath reservoir.

It is still a further object of the present invention to provide a foot bath having a housing having an inner wall defining a reservoir, a water jet for circulating fluid disposed in the reservoir, and a pump for pumping the fluid to the jet, wherein the fluid circulates in a predetermined flow pattern in the reservoir.

The above and other objects, advantages, and benefits of the present invention will be understood by reference to following detailed description and appended sheets of drawings.

DETAILED DESCRIPTION OF THE INVENTION

Figure 1:
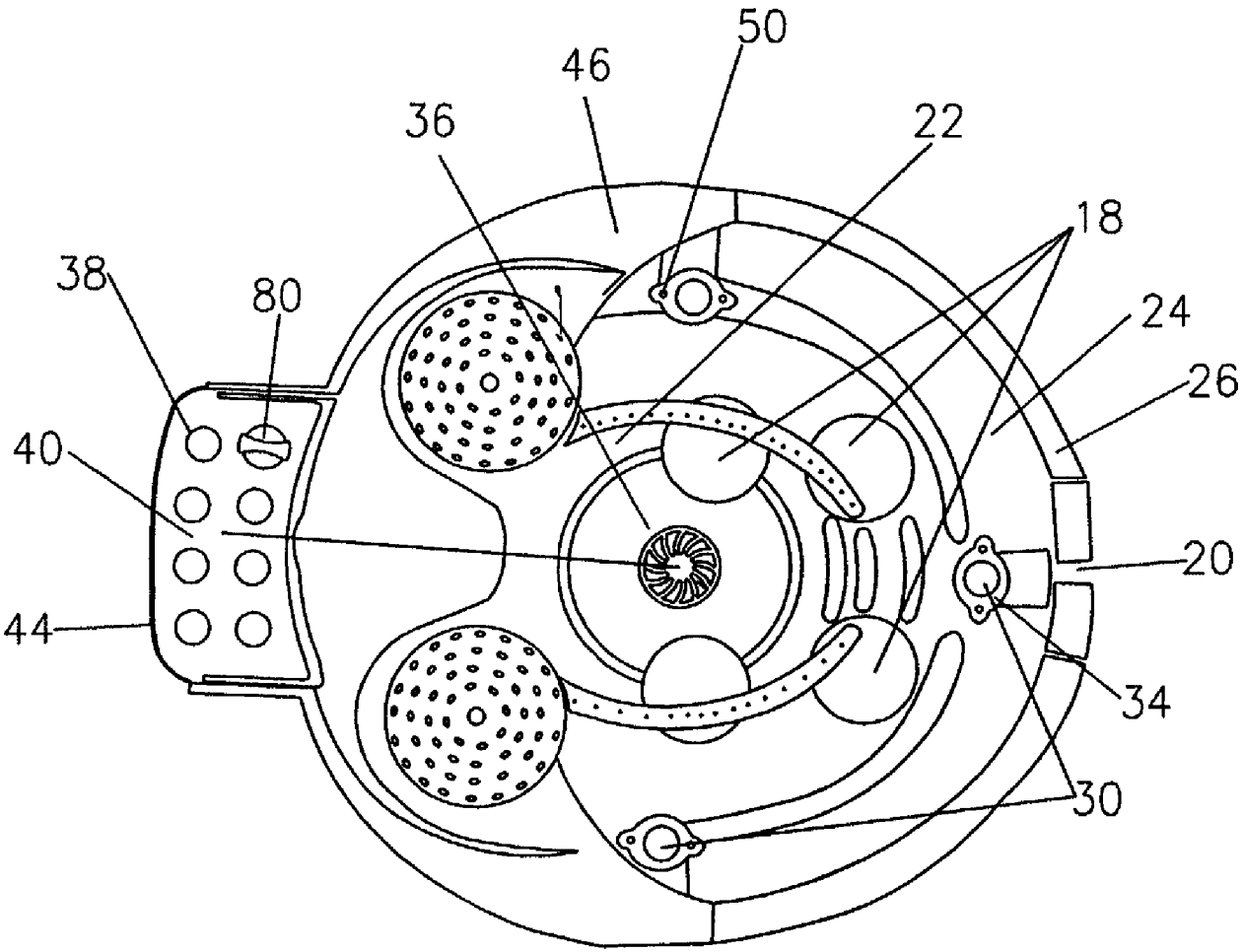
FIG. 1 is a top view of a foot bath in accordance with the present invention.

Referring to the drawings and in particular FIG. 1, there is provided a foot bath generally represented by reference numeral 10. Foot bath 10 includes a housing 20. Housing 20 has a floor 22, a sidewall 24 and a top wall or lip 26. Floor 22 and sidewalls 24 define a reservoir 28 for containing liquid. Feet and other body tissues of the user may be placed into reservoir 28 for therapeutic and relaxing massaging.

In an aspect of the present invention, floor 22 preferably has a number of adjustable water jets 30 disposed on or near floor 22. Water jets 30 extend through corresponding apertures 34 in floor 22. Apertures 34 are sealed or otherwise allow water jets 30 to extend through floor 22, in a water tight configuration.

Floor 22 has a number of raised contours 18 positioned thereon for facilitating the comfortable placement of the feet thereon. Floor 22 also includes a drain 36. Drain 36 is preferably disposed in the centermost region of floor 22. An exemplary aspect of drain 36 is that drain 36 exhausts the liquid contents of the reservoir 28 and allows fluid disposed in reservoir to communicate with pump 70.

Figure 2:
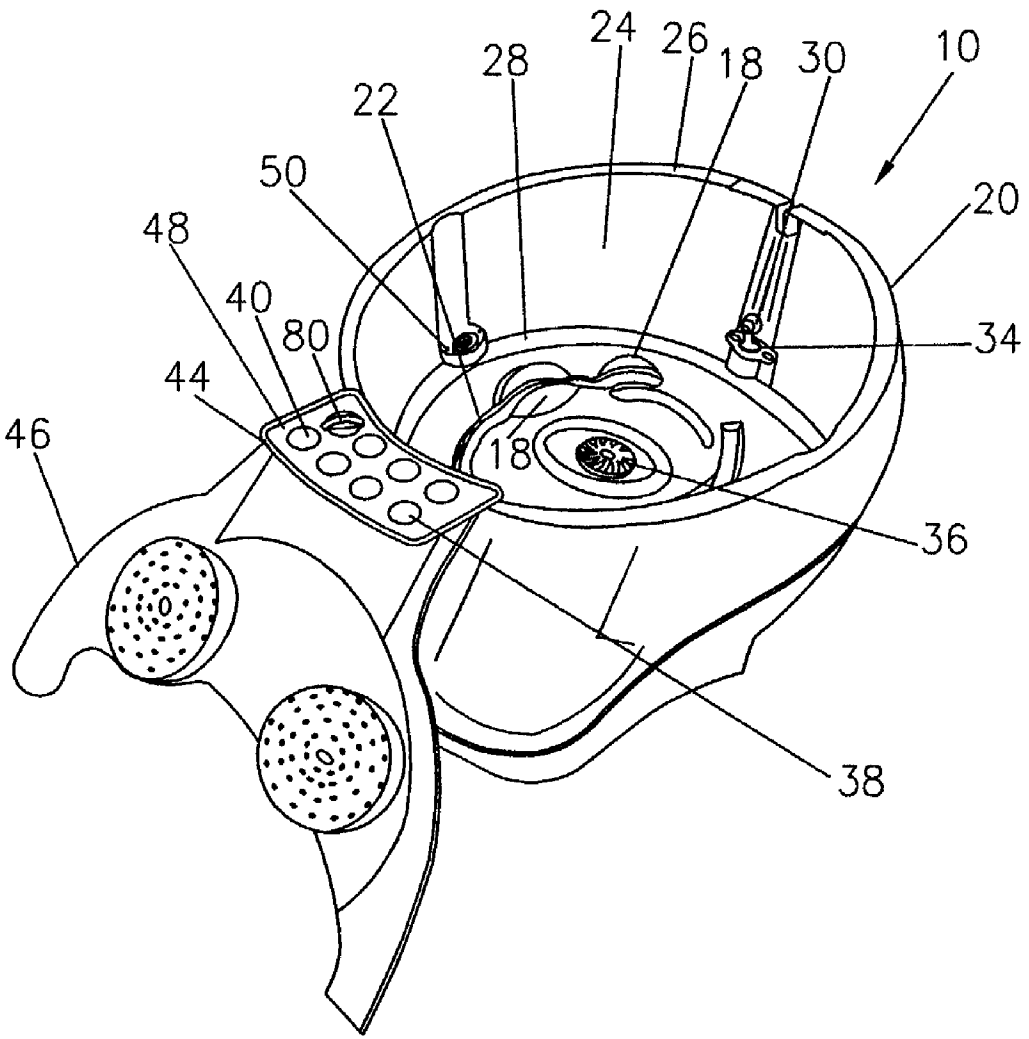
FIG. 2 is a perspective view of the foot bath of FIG. 1.
Figure 3:
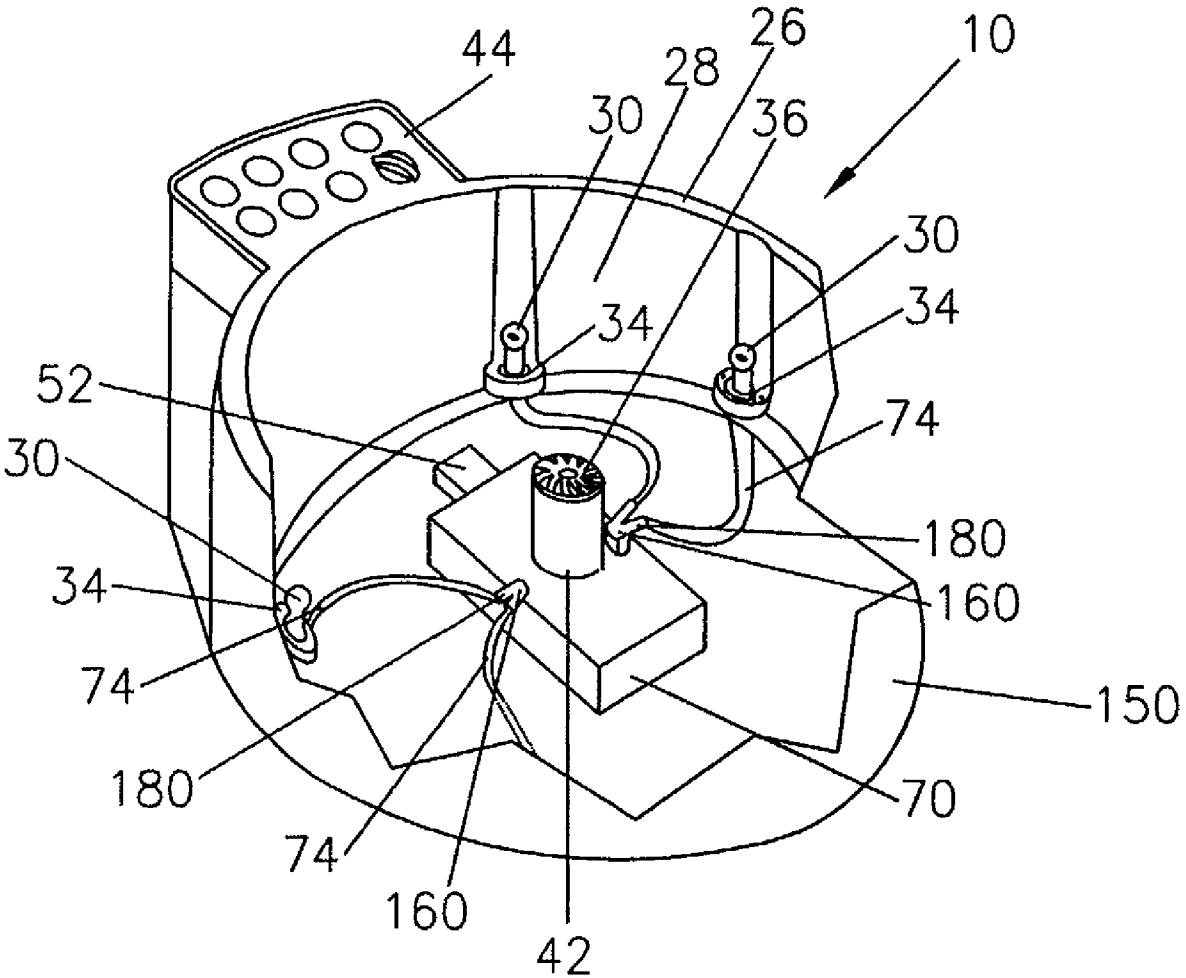
FIG. 3 is a cross sectional view of the foot bath of FIG. 1.

Foot Bath 10 also preferably includes an outwardly projecting lip 44. Lip 44 extends from top wall 26 of foot bath 10. Lip 44 may preferably be positioned in any suitable location on a perimeter of top wall 26. An exemplary aspect of the lip is that lip 44 has a sufficient surface area to accommodate a number of controls 38 thereon. For example as shown in FIGS. 1, 2 and 3, a rectangular control panel 40 is disposed on lip 44. Rectangular control panel 40 has controls 38 and associated circuitry (not shown) for controlling the operational functions of foot bath 10. Controls 38 may, for example, operate a heating sensation, a vibratory sensation, and an agitation control for a water jetting action of foot bath 10.

Referring to FIG. 2, housing 20 preferably has a lid 46 for at least partially covering reservoir 28. In an exemplary aspect of the present invention, lid 46 has a radius of curvature substantially equal to the radius of curvature of top wall 26. In this manner, when lid 46 is in a closed position partially covering reservoir 28, lid 46 matingly rests upon top wall 26. Lid 46 may be pivotally attached to top wall 26 by a cylindrical pin 48 disposed through lip 44. Lid 46 attaches to a respective side of pin 48. In this manner, the user may open and closed lid 46, by rotating lid 46 about pin 48.

In another exemplary embodiment of the present invention, lid 46 selectively retains a pair of detachable massaging pads (not shown) or any other foot massaging devices. The exemplary detachable massaging pads can be removably retained on the top of lid 46. Thus, the user may achieve a scrubbing action on the soles of the user's feet by manipulating the user's sole upon pads (not shown).

Referring to FIGS. 2 and 3, water jets 30 are affixed to floor 22. Water jets 30 may be disposed in any orientation on floor 22 or sidewall 24 to effect a predetermined flow pattern of the fluid contained in reservoir 28 around substantially an inner periphery of reservoir 28. An exemplary feature of water jets 30 is that water jets 30 facilitate or contribute to a high-velocity fluid stream forced under pressure out of at least one opening disposed on water jet 30. In an aspect of the present invention, the predetermined fluid flow pattern may include, for illustration purposes only, a vortex, elliptical, or circular motion. One skilled in the art should appreciate that the predetermined fluid flow pattern may include a spiral fluid flow pattern of the fluid in the reservoir 28 that tends to form a cavity or vacuum in substantially centermost region of reservoir 28 and the spiral fluid flow pattern.

In an exemplary embodiment of the present invention, floor 22 has one or more support members 50 disposed thereon. Water jets 30 are preferably disposed on a raised cylindrical support member 50 in spaced relation to sidewall 24. Support member 50 has a height suitable to effect a predetermined flow pattern of the fluid to massage the user's feet. Referring to FIG. 3, a pump 70 can be operatively connected to foot bath 10. The pump 70 can be in foot bath 10, and preferably positioned under reservoir 28 or can be external to foot bath 10. Water jets 30 are arranged for directing the fluid disposed in the reservoir 28 in a predetermined fluid flow pattern, as determined by the user. Water jets 30 may also be directed to direct fluid to predetermined specified area of the foot or, to pinpoint fluid to a specified area of the foot.

A pump 70 selectively circulates fluid disposed in reservoir 28. Pump 70 may be a centrifugal pump, a gear pump, a piston pump, a vane pump, a rotor or any other device or method suitable for pumping the fluid disposed in the reservoir 28 in a predetermined fluid flow pattern.

As discussed above, an aspect of the present invention includes the fluid flow pattern generated by foot bath 10 imparts a pleasant, therapeutic massaging stimulus exclusive of the vibrating sensation provided by vibrating mechanism 52. For example, a circular whirlpool fluid flow pattern can provide a relaxing fluid flow pattern that is relaxing and enjoyable. This is in contrast to the action of scrubbing the feet on a surface of foot bath 10 or a chaotic fluid flow pattern attributed by, for instance, a vibratory device.

Water jets 30 may rotate with respect to sidewall 24 in a number of directions, such as up, down, left and right. In this manner, the user may selectively manipulate water jets 30 to change the direction of the fluid flow pattern generated by foot bath 10. An exemplary embodiment of water jets 30 is that they may be connected via a spherical joint for rotation in the fore and aft direction. For example, water jets 30 maybe selectively directed to create a clockwise or counterclockwise predetermined fluid flow pattern in reservoir 28. The user can also selectively reposition or adjust water jets 30 to vary the magnitude of the predetermined fluid flow pattern.

Referring to FIG. 3, housing 20, floor 22 and sidewall 24 of reservoir 28 have positioned therebetween an interior compartment 150. In compartment 150 is disposed a vibrating mechanism 52. Vibrating mechanism 52 is attached under the floor 22 forward of the intake of pump 70. It will be appreciated by those skilled in the art that any of the known methods suitable for generating a vibratory motion in a foot bath may be used in foot bath 10 and are thus are within the scope of the present invention.

Compartment 150 also preferably has a heating wire 42 for at least maintaining the temperature of the fluid in reservoir 28. Heating wire 42 is electrically connected to a power source. When energized from the power source, heating wire 42 generates and transfers heat energy from it to the fluid in reservoir 28 and/or fluid entering the intake of pump 70. It should be appreciated by those skilled in the art that any of the known devices and methods suitable for generating heat in a foot bath may be used in foot bath 10 and are within the scope of the present invention.

As discussed above, water jets 30 extend through floor 22 via apertures 34. Each respective water jet 30 attaches to a respective hose 74. Hose 74 may be any flexible pipe, made of a non-porous suitable material, leather, rubber, or other material, and used for conveying fluids, especially water, from a pump 70 or any other device to respective water jets 30. Hose 74 connects the respective water jets 30 and pump 70. Hose 74 is disposed within compartment 150. In an illustrative embodiment of the present invention, pump 70 has a rectangular housing. The housing of the pump 70 has two tubular pump outlets 160. Tubular pump outlet 160 may be a pair of suitable sized apertures disposed in the housing of pump 70 for allowing fluid to escape pump 70. An exemplary aspect of both tubular pump outlets 160 is that each aperture of tubular pump outlet 160 has a corresponding molded Y fitting 180 attached thereto. An exemplary feature of molded Y fitting 180 is that molded Y fitting 180 may be any suitable device for respective hoses 74 to be in conformity or agreement with pump 70. Each respective molded Y fitting 180 is connected to tubular pump outlet 160. Four exemplary flexible hoses 74 attach to each respective outlet of the molded Y fitting 180. Water jets 30 connect with the pump 70 via hose 74 and molded Y fitting 180, all of which are retained in compartment 150. In this manner, fluid flows through drain 36 enters pump 70 and is circulated to respective water jets 30 disposed on floor 22.

In an illustrative embodiment of the present invention, the pressure of the fluid is increased such that the fluid is forced out pump 70. Pressurized fluid exits pump 70 through the tubular pump outlet 160, through molded Y fittings 180, through hose 74 to exit water jets 30. Water jets 30 circulate the fluid into reservoir 28 in a predetermined fluid flow pattern.

In one embodiment of the present invention, four water jets 30 are used to create the predetermined fluid flow pattern. Each respective water jet 30 is preferably individually connected to pump 70 by the exemplary hoses 74 and attached to each respective molded Y fitting 180. Pump 70 increases the force per unit volume of the fluid expelled through water jets 30.

In another exemplary embodiment of the present invention, pump 70 forces fluid through a number of water jets 30, specifically through an exemplary nozzle 76 disposed on each of the respective water jets 30. In a preferred embodiment, nozzles 76 of the water jets 30 are preferably positioned in a parallel relation adjacent to an immediate sidewall 24. Nozzles 76 may be a spiral nozzle, a clog resistant nozzle, a hollow cone nozzle, a two turn spiral nozzle, an omni-directional nozzle, a tangential inlet nozzle, a right angle nozzle, a wide spray nozzle or any other suitable high flow rate nozzle known in the art.

Operationally, fluid is drawn from reservoir 28 through drain 36 and heated by heater wire 42. One skilled in the art should appreciate that an exemplary inline heater may also be used to transfer heat energy to fluid. Then, the heated fluid is further drawn into pump 70. Pump 70 forces the heated fluid to water jets 30 through nozzles 76. In this manner, fluid from reservoir 28 is drawn into pump 70 through drain 36 and sent into reservoir 28 via nozzles 76 of water jets 30. The fluid is directed by water jets 30 into a predetermined fluid flow pattern in reservoir 28.

In an aspect of the present invention, the predetermined flow of the fluid may also be aided by the shape of contours 18 disposed in reservoir 28. The contours 18 disposed in reservoir 28 may be a number of circular shaped concentric channels, a number of arcuate shaped channels, or at least one spiral shaped channel for fluid to flow therethrough. Contour 18 may be any groove, bed, tubular enclosed passage, membrane, or gutter to create, maintain or contribute to a predetermined fluid flow pattern. The flow of fluid may be selectively modified by the user for achieving a predetermined fluid flow pattern.

It should also be appreciated by those skilled in the art that the particular foot bath functions and other aspects of the teachings herein are but examples of the present invention. Thus, they do not limit the scope or variety of applications that the present invention may be suitably implemented. Thus, it should be understood that the foregoing description is only illustrative of a present implementation of the teachings herein. Various alternatives and modification may be devised by those skilled in the art without departing from the invention. Accordingly, the present invention is intended to embrace all such alternatives, modifications, and variances that fall within the scope of the appended claims.

What is claimed is:

1. A foot bath comprising:

a housing having a side wall and a floor defining a reservoir for receiving a fluid;

at least two water jets being disposed in said reservoir; and a pump for pumping the fluid in said reservoir to said at least two water jets, for circulating the fluid disposed in said reservoir, wherein the fluid circulates in a predetermined fluid flow pattern in said reservoir, wherein said predetermined flow pattern is a net motion of the fluid around substantially an inner periphery of said reservoir.

2. The foot bath of claim 1, wherein said predetermined flow pattern is an elliptical motion of the fluid around substantially said inner periphery of said reservoir.

3. The foot bath of claim 1, wherein said predetermined flow pattern is a vortex motion of the fluid around substantially said inner periphery of said reservoir.

4. The foot bath of claim 1, wherein said predetermined flow pattern is a circular motion of the fluid around substantially said inner periphery of said reservoir.

5. The foot bath of claim 1, further comprising an intake located substantially in a centermost portion of said floor.

6. The foot bath of claim 1, wherein said predetermined flow pattern of said fluid is selected from the group consisting of a counter clockwise-motion of the fluid, or a clockwise motion of the fluid around substantially an inner periphery of said reservoir.

7. The foot bath of claim 1, wherein said water jets are adjustable for changing the direction of fluid expelled into said reservoir.

8. The foot bath of claim 1, wherein said floor and said side wall have contours, and wherein said contours facilitate circulation of said fluid in the predetermined fluid flow pattern.

9. The foot bath of claim 1, wherein said at least two water jets on or adjacent to said floor, wherein said at least two jets are connected to said pump and circulate the fluid disposed in said reservoir.

10. The foot bath of claim 1, wherein said at least two water jets each have a nozzle for adjusting a direction of the fluid expelled from said nozzle.

11. The foot bath of claim 1, wherein said floor has a plurality of circular channels disposed therein, wherein said channels facilitate the circulation of the fluid in said predetermined fluid flow pattern in said reservoir.

12. The foot bath of claim 1, further comprising a heater for at least maintaining a temperature of the fluid disposed in said reservoir.

13. The foot bath of claim 1, further comprising a vibratory mechanism that vibrates at least a portion of said housing.

14. The foot bath of claim 13, further comprising a compartment, said compartment having a water tight seal for preventing the fluid from escaping from said reservoir, wherein said compartment houses said vibratory mechanism, said pump and a heater.

15. The foot bath of claim 1, comprising a control pad for controlling an operational function of the foot bath.

16. The foot bath of claim 1, wherein said floor has a plurality of contours disposed on said floor, wherein said contours provide a massaging action.

17. The foot bath of claim 16, further comprising a lid removably secured to said housing, and a massaging member disposed on said lid for providing a massaging action.

18. The foot bath of claim 1, further comprising at least three water jets, said at least three water jet being disposed in a substantially circular manner on said floor.

19. The foot bath of claim 1, wherein said at least two water jets are disposed on a raised support member, said raised support member being disposed on said floor.

20. The foot bath of claim 1, wherein said at least two water jets are disposed in a channel, said channel is disposed in spaced relation to said side wall.

21. The foot bath of claim 1, wherein said at least two water jets in said reservoir release the fluid in a predetermined direction, wherein said predetermined direction facilitates circulating the fluid disposed in said reservoir in said predetermined fluid flow pattern, and wherein said predetermined flow pattern is suitable for a relaxing foot bath massage.

22. A foot bath comprising:

a housing having a side wall and a floor defining a reservoir for receiving a fluid, said floor having a drain, said fluid being received in said reservoir having an initial top surface level;

at least two water jets being disposed in said reservoir; and a pump for pumping the fluid in said reservoir to said at least two water jets, said at least two water jets for circulating the fluid disposed in said reservoir, wherein the fluid circulates in a predetermined spiral fluid flow pattern in said reservoir, wherein said predetermined spiral flow pattern is a net motion of the fluid around an inner periphery of said reservoir, said drain being substantially in a centermost portion of said reservoir, said predetermined fluid flow forming a whirlpool around said drain, said whirlpool flowing out of said drain and being in communication with said at least two water jets.

* * * * *